US008600244B2

(12) United States Patent
Hashimoto

(10) Patent No.: US 8,600,244 B2
(45) Date of Patent: Dec. 3, 2013

(54) NEW/USED CARTRIDGE DETECTION

(75) Inventor: Junichi Hashimoto, Toyohashi (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 184 days.

(21) Appl. No.: 13/305,878

(22) Filed: Nov. 29, 2011

(65) Prior Publication Data

US 2012/0134688 A1 May 31, 2012

(30) Foreign Application Priority Data

Nov. 30, 2010 (JP) ..... 2010-266412

(51) Int. Cl.
*G03G 15/00* (2006.01)
*G03G 21/16* (2006.01)
*G03G 15/08* (2006.01)

(52) U.S. Cl.
USPC ..... 399/12; 399/111; 399/119; 399/262

(58) Field of Classification Search
USPC ..... 399/12, 111, 119, 262
See application file for complete search history.

(56) References Cited

U.S. PATENT DOCUMENTS

| | | | | |
|---|---|---|---|---|
| 7,756,426 | B2 | 7/2010 | Kamimura | |
| 2006/0177230 | A1* | 8/2006 | Ishii | 399/12 |
| 2006/0193644 | A1* | 8/2006 | Takagi | 399/12 |
| 2006/0193645 | A1* | 8/2006 | Kishi | 399/12 |
| 2006/0193646 | A1* | 8/2006 | Suzuki et al. | 399/12 |
| 2007/0031158 | A1* | 2/2007 | Kamimura | 399/12 |
| 2008/0205911 | A1* | 8/2008 | Ishikawa et al. | 399/12 |
| 2009/0000423 | A1 | 1/2009 | Ishikawa et al. | |
| 2009/0269086 | A1* | 10/2009 | Mikuni | 399/12 |
| 2011/0243578 | A1* | 10/2011 | Ukai et al. | 399/12 |

FOREIGN PATENT DOCUMENTS

| | | | |
|---|---|---|---|
| JP | 05-204195 | A | 8/1993 |
| JP | 2001-042585 | A | 2/2001 |
| JP | 2006-267994 | A | 10/2006 |
| JP | 2007-047314 | A | 2/2007 |
| JP | 2009-014789 | A | 1/2009 |
| JP | 2009-244564 | A | 10/2009 |

OTHER PUBLICATIONS

Decision to Grant a Patent issued in Japanese Patent Application No. 2010-266412 dated Jan. 22, 2013.

* cited by examiner

*Primary Examiner* — G. M. Hyder
(74) *Attorney, Agent, or Firm* — Banner & Witcoff, Ltd.

(57) ABSTRACT

A developer cartridge includes a housing and a detection gear having a detection protrusion detectable by detecting device of an image forming apparatus. The detection gear is rotatable between a first position and a second position. In the first position, the detection protrusion is detectable by the detecting device and a gear toothed portion opposes an agitator gear. In the second position, the detection protrusion is undetectable by the detecting device and a toothless portion opposes the agitator gear. When the detection gear is in the first position, an urging portion of the housing contacts the detection gear and applies rotational force to urge the gear toothed portion toward the agitator gear. When in the second position, the urging portion contacts the detection gear and regulates the position of the detection gear in the rotational direction to cause the toothless portion and the agitator gear to oppose each other.

20 Claims, 11 Drawing Sheets

NEW/USED CARTRIDGE DETECTION

RELATED APPLICATIONS

This application claims priority to Japanese priority application number JP 2010-266412, filed Nov. 30, 2010, whose contents are expressly incorporated herein by reference.

TECHNICAL FIELD

One or more aspects of the present invention relate to cartridges that are removably mounted in main bodies of image forming apparatuses.

RELATED ART

In general, cartridges are known that contain developers therein and are removably mounted in main bodies of image forming apparatuses such as printers. Some image forming apparatuses in which such cartridges are removably mounted have a structure for detecting whether or not a cartridge mounted therein is a new product (referred to as "new product detection"). For example, one conventional approach discloses a mechanism that detects that a cartridge is a new product when a contact protrusion provided in a detection gear of the mounted cartridge (for instance, a developer cartridge) contacts an actuator provided in an apparatus.

The detection gear of this example is a partially toothed gear that is arranged in a position, when the cartridge is in a new product state, in which a toothed portion is engaged with an agitator drive gear and the contact protrusion can contact the actuator. When the cartridge is mounted in the image forming apparatus and a warm-up operation (for example, an initial turning operation of the agitator drive gear) is performed, the detection gear rotates, the contact protrusion is displaced to a position at which the contact protrusion cannot contact the actuator, and the toothless portion opposes the agitator drive gear in order to stop the transfer of a driving force. With such a structure, when a used cartridge is removed from the image forming apparatus and mounted again, the contact protrusion does not contact the actuator, thereby detecting that the cartridge is a used product.

The above-described related-art cartridge has a coil spring mounted therein in order to urge the detection gear for the toothed portion of the detection gear to be reliably engaged with the agitator drive gear in the new product state. However, since the structure involved in the new product detection of a cartridge is a part that functions once and then ceases to function, it is desirable that the number of components thereof be reduced as much as possible, thereby reducing the cost and facilitating assembly.

SUMMARY

One or more aspects of the present invention are proposed in view of the above-described background. At least one aspect of the present invention provides a cartridge with which the number of components involved in the structure of the new product detection can be reduced.

In one embodiment, a cartridge, removably mounted in a main body of an image forming apparatus, includes a housing that contains a developer, a first rotating body that has a detection target portion detectable by detecting means of the main body of the image forming apparatus and is provided in the housing such that the first rotating body is rotatable relative to the housing, and a second rotating body that is provided in the housing such that the second rotating body is rotatable relative to the housing and able to transfer driving force input from the main body of the image forming apparatus to the first rotating body. In the cartridge, the first rotating body has a transfer portion that rotates, when the transfer portion opposes the second rotating body, the first rotating body by causing the driving force to be transferred from the second rotating body, and a non-transfer portion that disables, when the non-transfer portion opposes the second rotating body, transfer of the driving force from the second rotating body. In the cartridge, the first rotating body is rotatable between a first position and a second position. In the first position, the detection target portion is detectable by the detecting means and the transfer portion opposes the second rotating body. In the second position, the detection target portion is undetectable by the detecting means and the non-transfer portion opposes the second rotating body. In the cartridge, the housing has an elastic urging portion integrally formed therein, which contacts, when the first rotating body is in the first position, the first rotating body and applies rotational force so as to urge the transfer portion toward the second rotating body, and contacts, when the first rotating body is in the second position, the first rotating body and regulates the position of the first rotating body in the rotational direction so as to cause the non-transfer portion and the second rotating body to oppose each other.

With the cartridge having a structure as described above, the housing has the elastic urging portion integrally formed therein, which contacts, when the first rotating body is in the first position, the first rotating body and applies the rotational force so as to urge the transfer portion toward the second rotating body. The elastic urging portion also contacts, when the first rotating body is in the second position, the first rotating body and regulates the position of the first rotating body in the rotational direction so as to cause the non-transfer portion and the second rotating body to oppose each other. Thus, a spring as a separate component can be omitted, and accordingly, the number of components of the structure involved in the new product detection can be reduced.

According to the present invention, the urging portion is integrally formed in the housing of the cartridge. Thus, the spring as a separate component can be omitted, thereby allowing the number of components of the structure involved in the new product detection to be reduced.

DESCRIPTION OF EMBODIMENTS

It is noted that various connections are set forth between elements in the following description. These connections are described in general and, unless specified otherwise, may be direct or indirect; this specification is not intended to be limiting in this respect.

For purposes herein, aspects of the invention are shown in relation to an image carrier and developer carrier. In various aspects, the image carrier may include a photosensitive drum, photosensitive belt, or the combination of one of a photosensitive drum or belt and an intermediate transfer drum or belt. Further, the developer carrier may include a developer roller or other systems for conveying developer to the image carrier.

The printer described herein is a color printer. Unless specifically restricted to a color printer, the term "printer" or "image forming apparatus" is not intended to be limited to a color printer but also is intended to encompass monochrome printers and the like.

Developer cartridges are referenced herein as including a developer roller and a toner containing portion to assist with explanation. It is appreciated that often the developer cartridge may include developer roller while not including the toner containing portion. In further situations, the developer roller of the developer cartridge may be replaced with another system for providing toner to a photosensitive drum or belt. For example, the developer roller may be replaced by a varying electric field that transports charged toner to the photosensitive drum or belt. The term "developer cartridge" is not intended to be limited solely to a specific example including or not including a developer roller unless specifically stated.

The term "cartridge" is intended to be non-limiting in that it is intended to include photosensitive drum/belt (image carrier) cartridges, developer roller/other developer conveying system (developer carrier) cartridges, toner cartridges without developer rollers (that supply developer directly to a photosensitive drum or belt), combinational cartridges of two or more of an image carrier/developer carrier/a toner supply, and the like.

First Embodiment

A first embodiment according to the present invention will be described in detail with reference to the drawings where appropriate. In the following description, a general structure of a color printer 1 (image forming apparatus), in which a developer cartridge 60 as an example of a cartridge according to the present embodiment is removably mounted, and a structure involved in new product detection will be briefly described. Then, a detailed structure of the developer cartridge 60 will be described.

Also in the following description, directions are described with reference to the user that uses the color printer 1. That is, the right, left, front, and rear sides in FIG. 1 respectively indicate "front", "rear", "left" and "right". Also in FIG. 1, an upper-lower direction indicates "upper-lower".

General Structure of Color Printer

Figure 1:
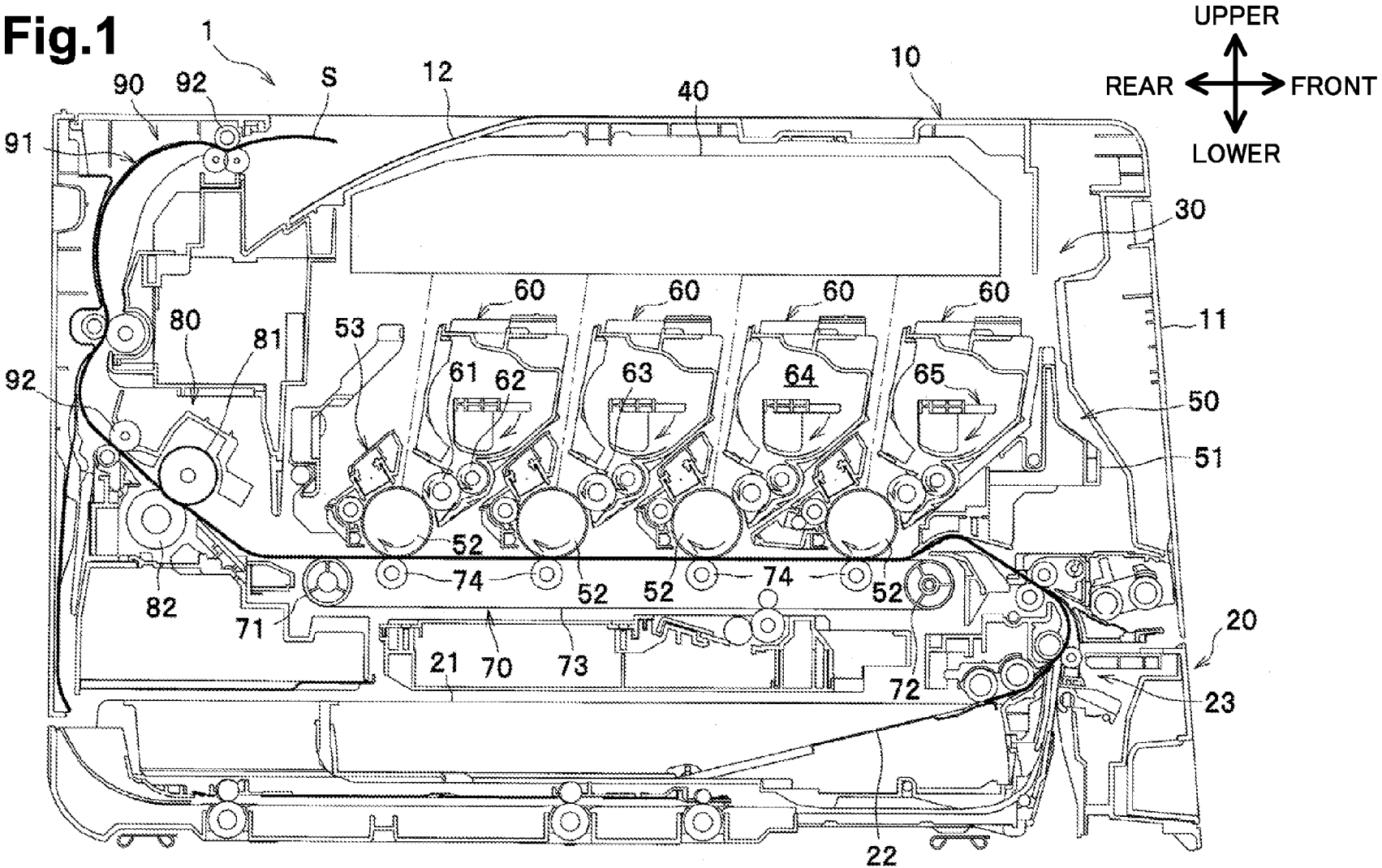
FIG. 1 illustrates a general structure of a color printer in which a developer cartridge as an example of a cartridge according to the first embodiment is removably mounted.

As illustrated in FIG. 1, the color printer 1 mainly includes a sheet feed portion 20, an image forming portion 30, and a sheet ejecting portion 90 in a main body case 10, which is an example of a main body of the image forming apparatus. The sheet feed portion 20 feeds a sheet of paper S, an image forming portion 30 forms an image on the sheet S having been fed, and the sheet ejecting portion 90 ejects the sheet S on which an image has been formed.

The sheet feed portion 20, which is provided in a lower portion in the main body case 10, mainly includes a sheet feed tray 21, sheet pressure plate 22, and a sheet feed mechanism 23. The sheet S loaded in the sheet feed tray 21 is pushed upward with the sheet pressure plate 22, and fed to the image forming portion 30 with the sheet feed mechanism 23.

The image forming portion 30 mainly includes an exposure unit 40, a photoreceptor unit 50, four developer cartridges 60, a transfer unit 70, and a fixing unit 80.

The exposure unit 40 is provided in an upper portion in the main body case 10 and includes components (not shown) such as a laser light source, a polygon mirror, a plurality of lenses, and a plurality of reflectors. Laser beams emitted from the laser light source in accordance with image data are reflected by the polygon mirror and the reflectors, transmitted through the lenses, and scanned at a high speed at the surfaces of photoreceptor drums 52 (refer to the dotted lines).

The photoreceptor unit 50 is disposed between the sheet feed tray 21 and the exposure unit 40 and mainly includes an upwardly open substantially box-shaped drawer 51, four photoreceptor drums 52, and four chargers 53. The photoreceptor drums 52 are arranged side by side in the front-rear direction, and the chargers 53 are provided corresponding to the respective photoreceptor drums 52. The drawer 51 is removable (drawable) in the front-rear direction relative to the main body case 10 by opening a front cover 11, which is provided in the front of the main body case 10 (refer to FIG. 2).

The developer cartridges 60 are arranged in the front-rear direction in the drawer 51. The developer cartridges 60 are removable relative to the drawer 51, and removably mounted in the main body case 10 in a state in which the developer cartridges 60 are mounted in the drawer 51 (refer to FIG. 2). Each developer cartridge 60 mainly includes a developer roller 61, a feed roller 62, a layer thickness regulating blade 63, a toner containing portion 64, and an agitator 65. The toner containing portion 64 contains toner, which is an example of a developer, and the agitator 65 agitates toner contained in the toner containing portion 64. The detailed structure of the developer cartridge 60 will be described later.

The transfer unit 70 is provided between the sheet feed tray 21 and the photoreceptor unit 50 and mainly includes a drive roller 71, a driven roller 72, an endless transport belt 73 that is stretched between the drive roller 71 and the driven roller 72, and four transfer rollers 74. The transport belt 73 contacts the photoreceptor drums 52 at the outer side thereof. The transfer rollers 74 are disposed at the inner side of the transport belt 73 such that the transfer rollers 74 and the corresponding photoreceptor drums 52 pinch the transport belt 73 therebetween.

The fixing unit 80 is provided behind the photoreceptor unit 50 and mainly includes a heating roller 81 and a pressure roller 82. The pressure roller 82 is provided opposite the heating roller 81 so as to push the heating roller 81.

In the image forming portion 30, the surface of each photoreceptor drum 52 is uniformly charged using the corresponding one of the chargers 53, and then an electrostatic latent image is formed on the photoreceptor drum 52 in accordance with the image data by an exposure of the photoreceptor drum 52 to the laser beam from the exposure unit 40. The toner contained in the toner containing portion 64 is fed to the respective developer roller 61 using the feed roller 62, enters a nip between the developer roller 61 and the layer thickness regulating blade 63 so as to be carried by the developer roller 61 as a thin layer having a certain thickness.

The toner carried by the developer roller 61 is fed to the photoreceptor drum 52 so as to make the electrostatic latent image be visible and form a toner image on the photoreceptor drum 52. After that, by transporting the sheet S fed from the sheet feed portion 20 through a nip between the photoreceptor drums 52 and the transport belt 73 (transfer rollers 74), the toner image formed on each photoreceptor drum 52 is transferred on the sheet S in a way that the toner images on the respective photoreceptor drums 52 are sequentially superimposed on the sheet S. The sheet S on which the toner images have been transferred is transported through a nip between the heating roller 81 and the pressure roller 82 so as to thermally fix the toner images thereto.

The sheet ejecting portion 90 mainly includes a sheet ejecting path 91 that guides the sheet S transported from the fixing unit 80 and a plurality of transportation rollers 92 that transport the sheet S. The sheet S to which the toner images have been thermally fixed is transported through the sheet ejecting path 91 using the transportation rollers 92, ejected to the outside of the main body case 10, and placed in a sheet delivery tray 12.

Structure Involved in New Product Detection in Color Printer

Next, an outline of a structure of the new product detection in the color printer 1 will be described. Since a known structure can be adopted as the structure of the new product detection provided in the color printer 1 (image forming apparatus), detailed descriptions are omitted herein.

Figure 2:
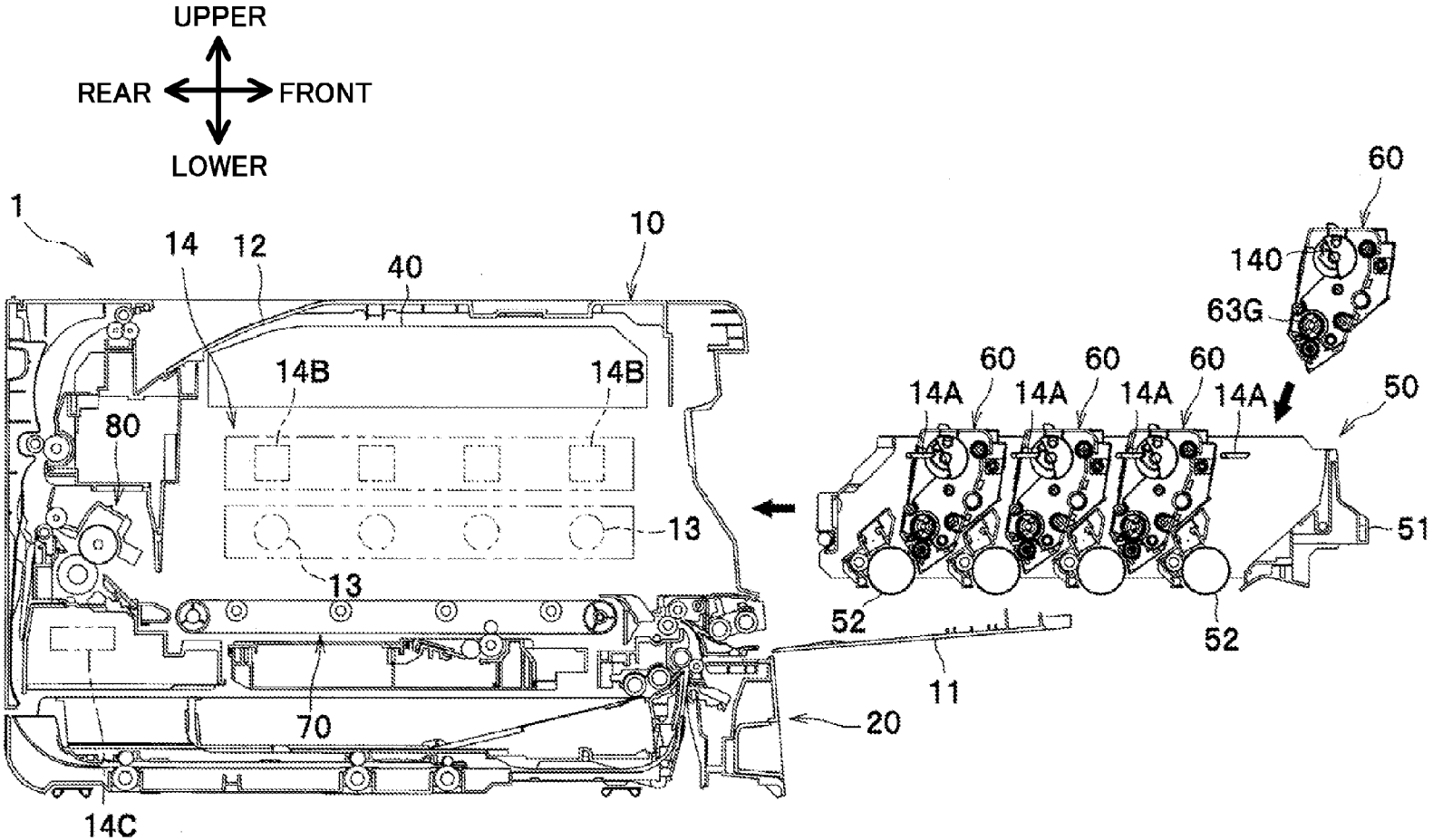
FIG. 2 illustrates an outline of a structure of new product detection in the color printer.

As illustrated in FIG. 2, the color printer 1 includes drive devices 13 and a new product detection device 14 as components of the new product detection. The drive devices 13 input driving force to the developer cartridges 60, and the new product detection device 14 detects whether or not the developer cartridges 60 are new products.

The drive devices 13 are provided in an area where the developer cartridges 60, which are mounted in the drawer 51, are mounted in the main body case 10. Each drive device 13 mainly includes the following components, which are not shown. That is, a motor, a driving force input member that inputs the driving force to an input gear 63G, which will be described later, of the developer cartridge 60, and a plurality of gears that transfer the driving force of the motor to the driving force input member.

The driving force input member is, for example, made to move forward or backward relative to the developer cartridge 60 in conjunction with opening or closing of the front cover 11. The driving force input member is engaged with the input gear 63G when the developer cartridge 60 is mounted in the main body case 10 and the front cover 11 is closed. By doing this, the driving force of the motor can be transferred to the developer cartridge 60.

The new product detection device 14 mainly includes detection arms 14A provided in the drawer 51, optical sensors 14B, and a control device 14C. The optical sensors 14B, the combination of the optical sensors 14B and the detection arms 14A, and the combination of the detection arms 14A, the optical sensors 14B and the control device 14C are all examples of detecting means. The detecting means may alternatively or additionally include mechanical sensors, magnetic sensors, electrical sensors, and/or any other known types of sensors.

Figure 7A:
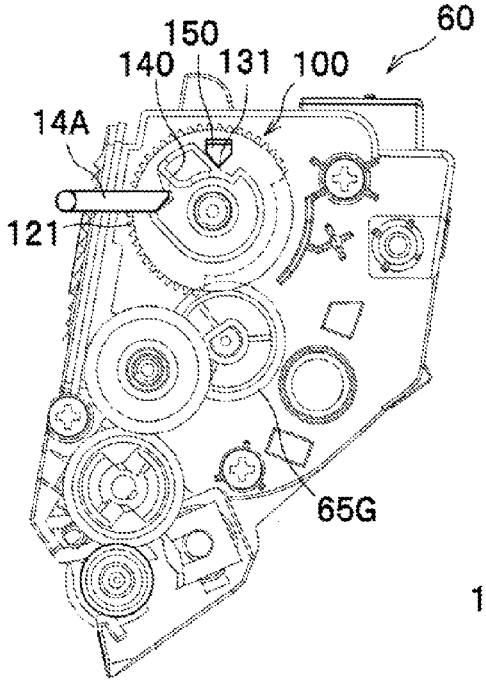
FIG. 7 includes the following views illustrating operations of the detection gear: view (a) that illustrates a state in which the developer cartridge is mounted in a main body case, view (b) that illustrates a state in which a detection arm swings due to contact with a detection protrusion, and view (c) that illustrates a state in which the detection arm returns to a neutral position.
Figure 7B:
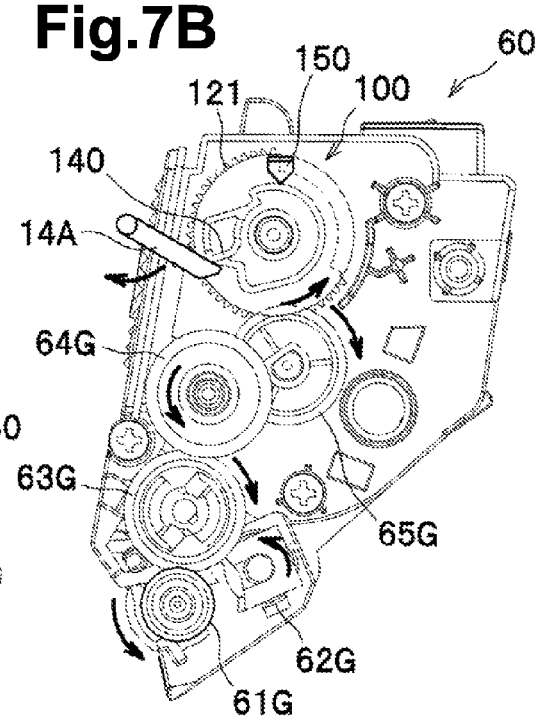
Figure 7C:
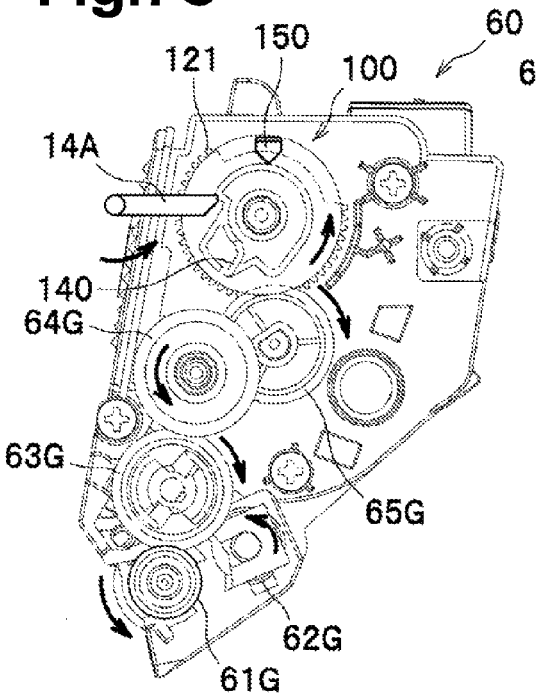

Each detection arm 14A is supported such that the detection arm 14A is swingable relative to the drawer 51, and constantly urged with a spring (not shown) to a neutral position (position illustrated in FIG. 2 and FIG. 7 (*a*)). As described later, when the developer cartridge 60 in a new product state is mounted, due to an initial turning operation, the detection arm 14A is contacted by a detection protrusion 140 as an example of a detection target portion and swings. The detection arm 14A returns to the neutral position after the detection protrusion 140 goes beyond the detection arm 14A. Also as described later, when the developer cartridge 60 in a used product state is mounted, the detection arm 14A does not swing because the detection protrusion 140 does not contact the detection arm 14A even when the initial turning operation is performed.

Here, in the present embodiment, the term "initial turning operation" refers to an operation performed at such a time as when the developer cartridge 60 is mounted in the main body case 10 or before an image forming operation is performed, in which the developer roller 61, the feed roller 62, the agitator 65, and so forth are preliminarily rotated. By doing this, the toner in the toner containing portion 64 is agitated and fed to the developer roller 61 using the feed roller 62.

Each optical sensor 14B is provided in the main body case 10 and detects the presence or the absence of a swing of the detection arm 14A. In the present embodiment, the optical sensor 14B outputs a specified signal to the control device 14C upon detection of a swing of the detection arm 14A.

The control device 14C controls operations of the color printer 1. In the present embodiment, the control device 14C also has a function of detecting whether or not the developer cartridge 60 is a new product in accordance with the presence or the absence of the swing of the detection arm 14A, which is detected by the optical sensor 14B. The control device 14C also causes the initial turning operation to be performed at such a time as when the developer cartridge 60 is mounted in the main body case 10 (for example, when a close signal is received from a sensor that detects a closing operation of the front cover 11), when image data (image forming instruction) is input, or when the power of the color printer 1 is turned on.

During the initial turning operation, the control device 14C determines that the developer cartridge 60 is a new product if the specified signal is output from the optical sensor 14B, and determines that the developer cartridge 60 is a used product if the specified signal is not output from the optical sensor 14B.

Detailed Structure of Developer Cartridge

Next, the detailed structure of the developer cartridge 60 will be described.

Figure 3B:
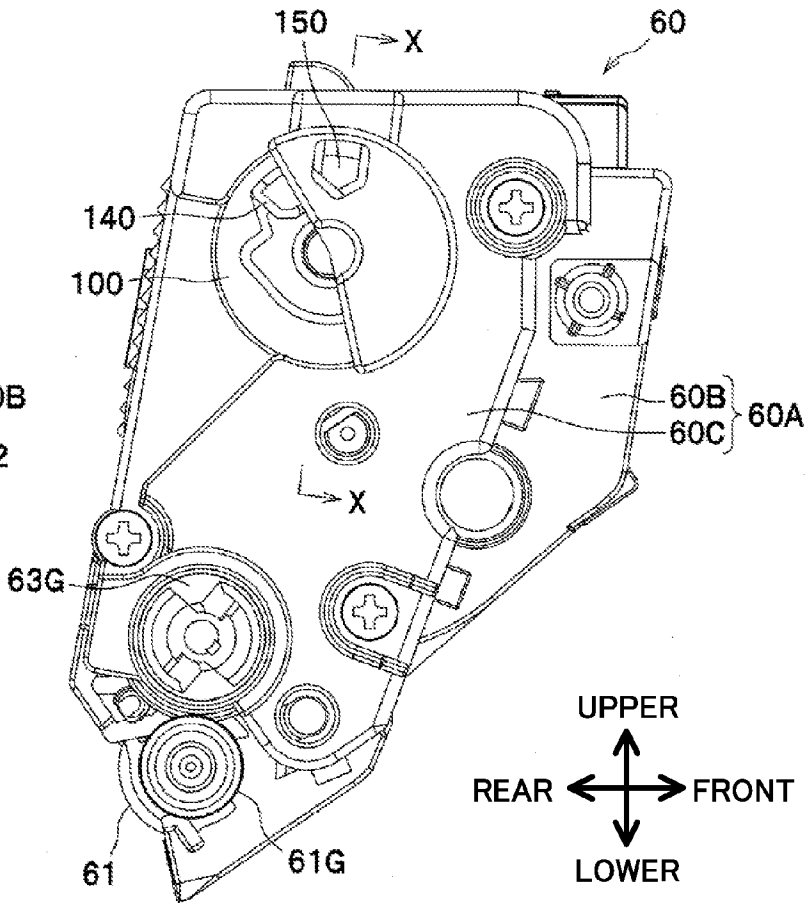
FIG. 3 includes the following sectional views of the developer cartridge: view (a) that illustrates a state in which a cover body is removed, and view (b) that illustrates a state in which the cover body is mounted.
Figure 3A:
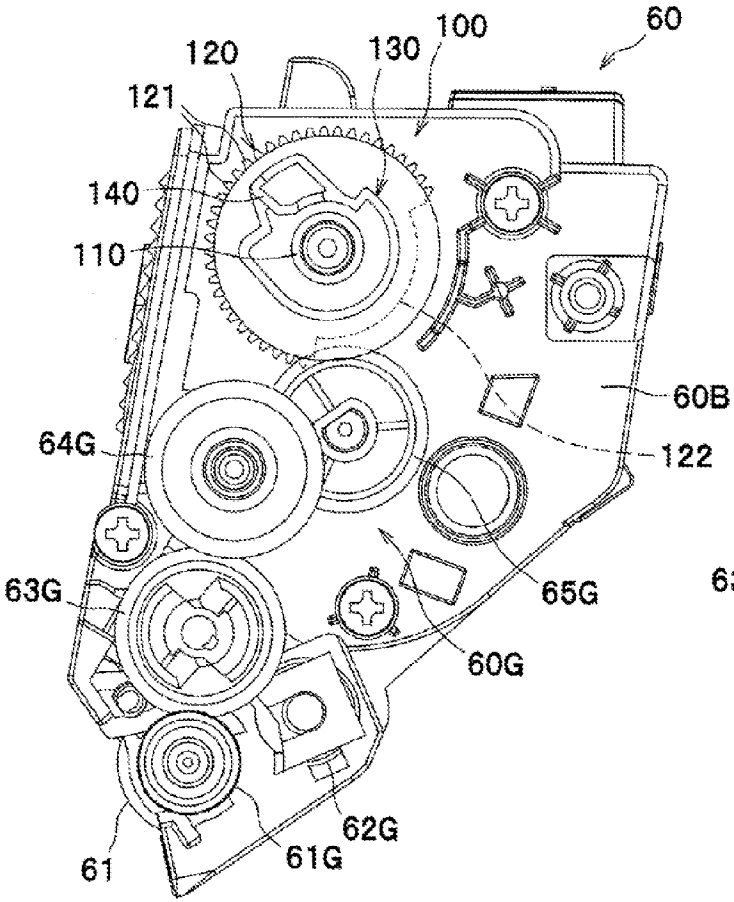

As illustrated in FIGS. 3 (*a*) and 3 (*b*), in addition to the above-described components such as the developer roller 61, each developer cartridge 60 further includes a housing 60A, a gear mechanism 60G, a detection gear 100 as an example of a first rotating body.

The housing 60A mainly includes a cartridge main body 60B and a cover body 60C. The cartridge main body 60B supports components such as the developer roller 61, the feed roller 62, and the agitator 65, and forms the toner containing portion 64. The cover body 60C is mounted at the left side surface of the cartridge main body 60B so as to cover an agitator gear 65G, which will be described later, and the like of the gear mechanism 60G and the detection gear 100.

The gear mechanism 60G transfers the driving force externally (from the drive device 13) input to the developer cartridge 60 to the developer roller 61, the feed roller 62, and the agitator 65, and is mounted at the left side surface of the cartridge main body 60B. This gear mechanism 60G includes the input gear 63G, a developer roller gear 61G, a feed roller gear 62G, and the agitator gear 65G. The input gear 63G is a gear to which the driving force is input from the drive device 13, the developer roller gear 61G and the feed roller gear 62G are engaged with the input gear 63G, and the agitator gear 65G is engaged with the input gear 63G with an intermediate gear 64G provided therebetween. Each gear is provided so as to be rotatable relative to the cartridge main body 60B (housing 60A).

The developer roller gear 61G, the feed roller gear 62G, and the agitator gear 65G respectively rotate the developer roller 61, the feed roller 62, and the agitator 65, and are respectively integrally provided at the ends of the rotation shafts of the developer roller 61, the feed roller 62, and the agitator 65. In the present embodiment, the agitator gear 65G is an example of a second rotating body that can transfer the driving force input from the drive device 13 in the main body case 10 to the detection gear 100.

The detection gear 100 mainly includes a cylindrical shaft engaging portion 110, a gear portion 120, a contact surface 130, and the detection protrusion 140 (detection target portion). The gear portion 120 and the contact surface 130 are formed around the shaft engaging portion 110, and the detection protrusion 140 can be detected by the optical sensor 14B in the main body case 10 using the detection arm 14A.

Figure 4B:
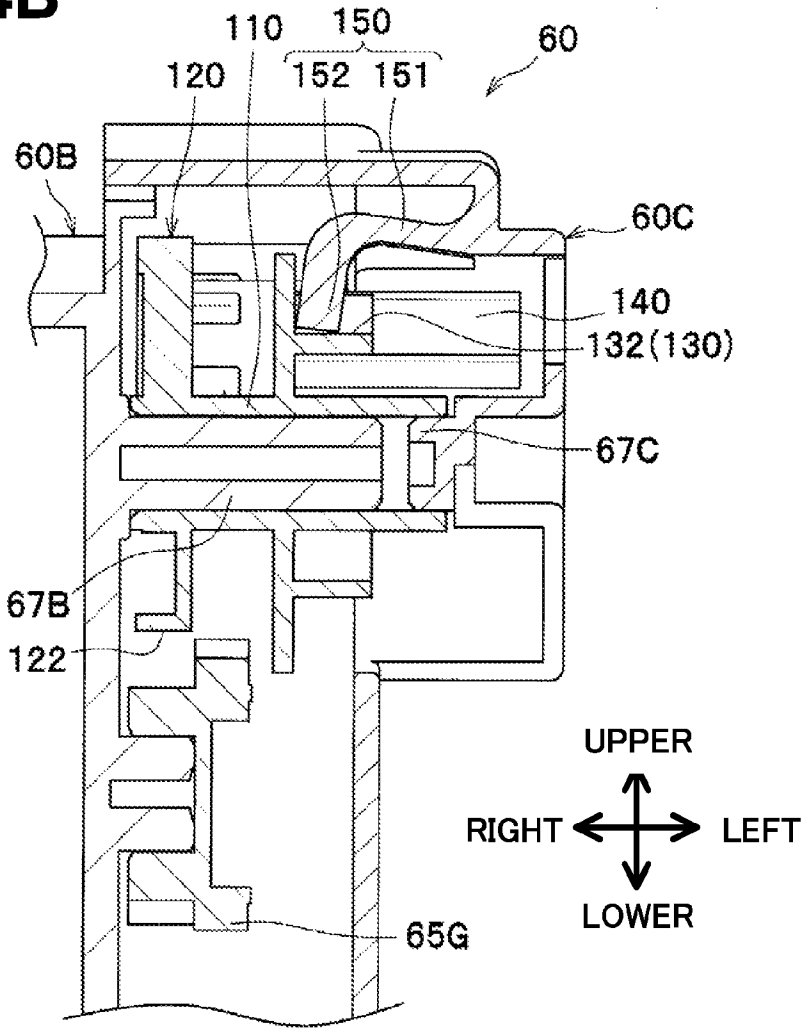
FIG. 4 includes the following views corresponding to sectional views taken along line X-X in FIG. 3: view (a) that illustrates a state in which a detection gear is in a first position, and view (b) that illustrates a state in which the detection gear is in a second position.
Figure 4A:
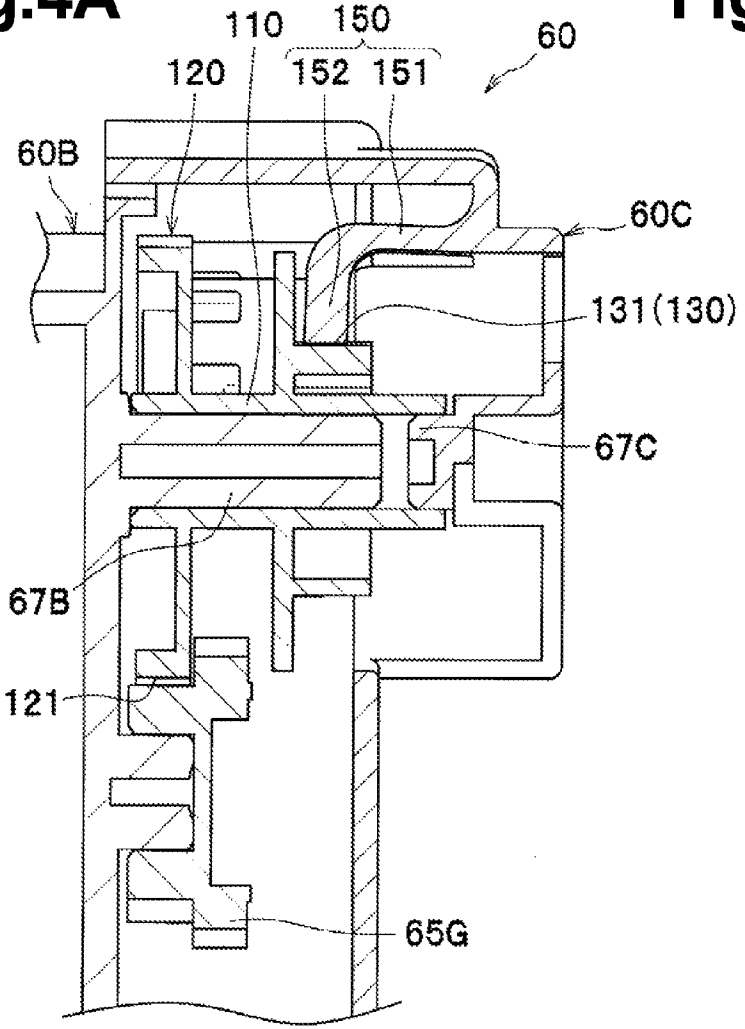

As illustrated in FIG. 4 (*a*), a rotation shaft 67B provided in the left side surface of the cartridge main body 60B and a rotation shaft 67C provided in an inner surface of the cover body 60C are each engaged with the shaft engaging portion 110. Thus, the detection gear 100 is provided (supported) such that the detection gear 100 is rotatable relative to the cartridge main body 60B and the cover body 60C (housing 60A).

Figure 5B:
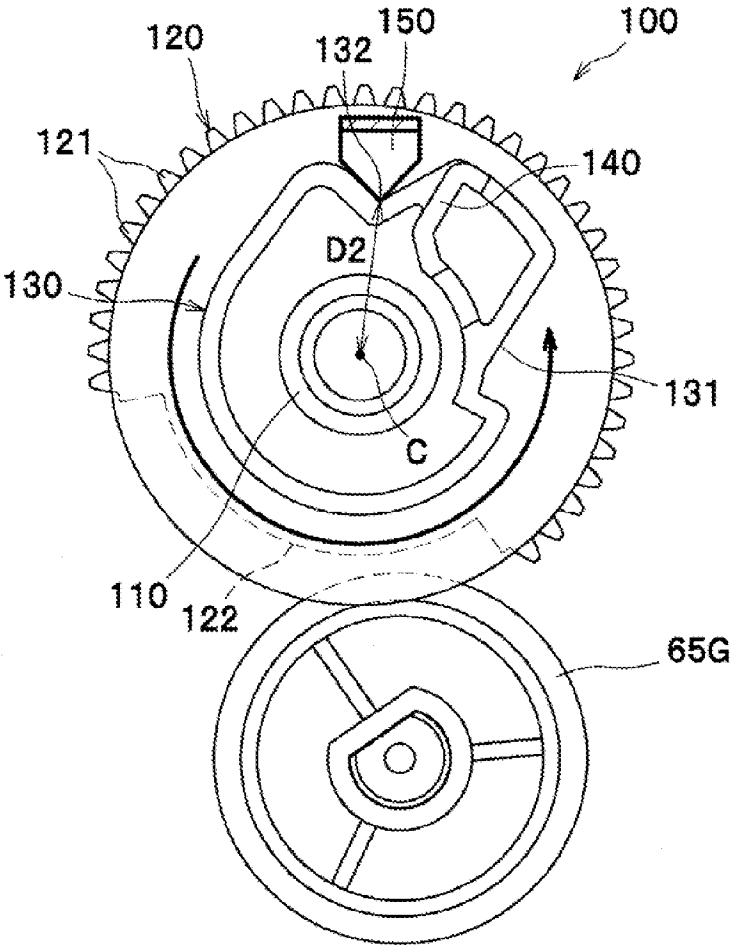
FIG. 5 includes the following views of the detection gear and an agitator gear: view (a) that illustrates a state in which the detection gear is in the first position, and view (b) that illustrates a state in which the detection gear is in the second position.
Figure 5A:
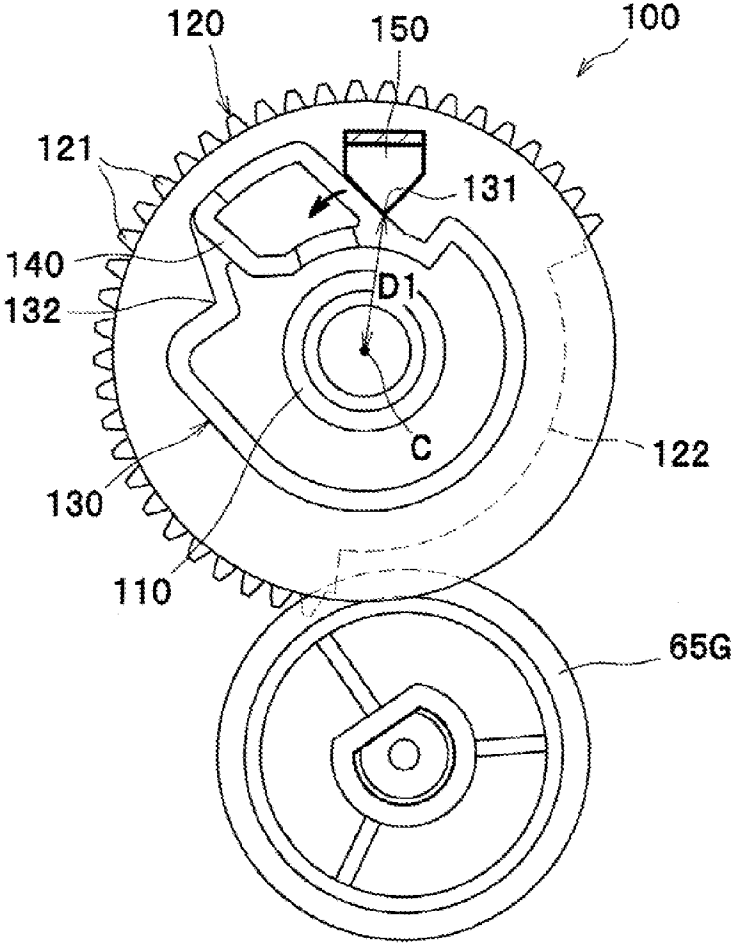

The gear portion 120 is provided so as to oppose the agitator gear 65G, and, as illustrated in FIG. 5 (*a*), has a gear toothed portion 121 as an example of a transfer portion and toothless portion 122 as an example of a non-transfer portion in the outer periphery.

As illustrated in FIGS. 4 (*a*) and 5 (*a*), when the developer cartridge 60 is in the new product state, the gear toothed portion 121 of the gear portion 120 opposes the agitator gear 65G and is engaged with the agitator gear 65G. Thus, when the gear toothed portion 121 opposes the agitator gear 65G, the driving force is transferred from the agitator gear 65G, thereby allowing the detection gear 100 to be rotated.

In contrast, as illustrated in FIGS. 4 (*b*) and 5 (*b*), when the developer cartridge 60 is in the used product state, the toothless portion 122 of the gear portion 120 opposes the agitator gear 65G and is not engaged with the agitator gear 65G. Thus, when the toothless portion 122 opposes the agitator gear 65G, transfer of the driving force from the agitator gear 65G can be prevented, thereby preventing the detection gear 100 from being rotated.

When the developer cartridge 60 is in the new product state, as illustrated in FIGS. 4 (*a*) and 5 (*a*), the detection gear 100 is in a position such that the gear toothed portion 121 opposes the agitator gear 65G (hereafter this state is referred to as a "first position"). When the developer cartridge 60 is in the used product state, as illustrated in FIGS. 4 (*b*) and 5 (*b*), the detection gear 100 is in a position such that the toothless portion 122 opposes the agitator gear 65G (hereafter this state is referred to as a "second position"). The detection gear 100 is rotatable between the first position and the second position. Operations of the detection gear 100 will be described later.

As illustrated in FIGS. 5 (*a*) and 5 (*b*), the contact surface 130 is contacted by an urging portion 150, which will be described later, is provided so as to surround the shaft engaging portion 110 in an area radially outside the inner peripheral surface of the shaft engaging portion 110 (surface supporting rotation of the detection gear 100), and faces toward a radially outer direction of the detection gear 100. The contact surface 130 includes a first contact portion 131 and a second contact portion 132. The first contact portion is contacted by the urging portion 150 when the detection gear 100 is in the first position illustrated in FIG. 5 (*a*), and the second contact portion 132 is contacted by the urging portion 150 when the detection gear 100 is in the second position illustrated in FIG. 5 (*b*). In the present embodiment, the surface of the contact surface 130 from the first contact portion 131 to the second contact portion 132 is continuous so as to extend substantially along a peripheral direction of the shaft engaging portion 110. Thus, the urging portion 150 slidably contacts the contact surface 130 during the initial turning operation. In alternative embodiments, the surface of the contact surface 130 from the first contact portion 131 to the second contact portion 132 is not necessarily continuous (and even may include gaps) as long as the urging portion 150 is permitted to proceed along contact surface 130 eventually reaching second contact portion 132.

Also in the present embodiment, the contact surface 130 is formed such that a distance D2 between the rotation center C of the detection gear 100 and the leading end of the urging portion 150 that is in contact with the second contact portion 132 is larger than the distance D1 between the rotational center C and the leading end of the urging portion 150 that is in contact with the first contact portion 131. Thus, urging force of the urging portion 150 (force with which the urging portion 150 pushes the contact surface 130) when the detection gear is in the second position can be made to be larger than that when the detection gear is in the first position.

The detection protrusion 140 is provided at a position radially shifted relative to the rotation center C in the left side surface of the detection gear 100. Specifically, the detection protrusion 140 is provided so as to protrude outward (leftward) from near an area between the first contact portion 131 and the second contact portion 132 (also refer to FIG. 4 (*b*)).

Figure 8A:
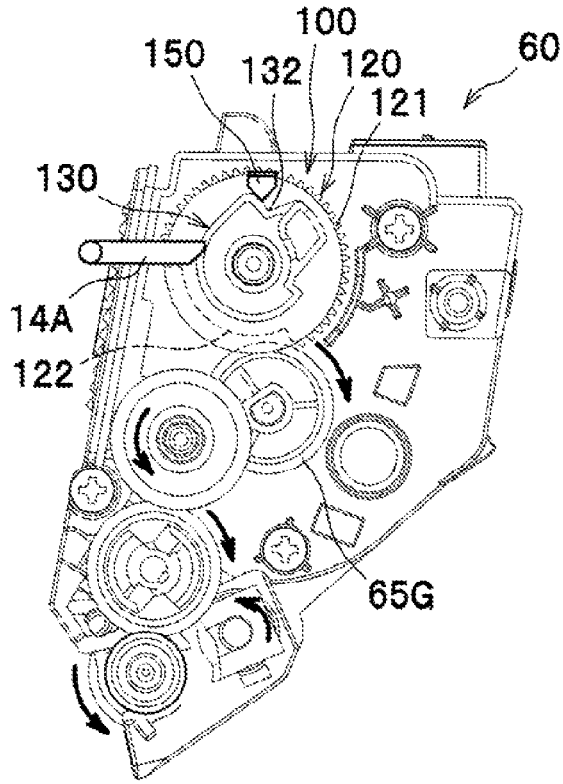
FIG. 8 includes the following views illustrating the operations of the detection gear: view (a) that illustrates a state in a moment when a toothless portion of the detection gear opposes the agitator gear, and view (b) that illustrates a state of the detection gear in the second position.
Figure 8B:
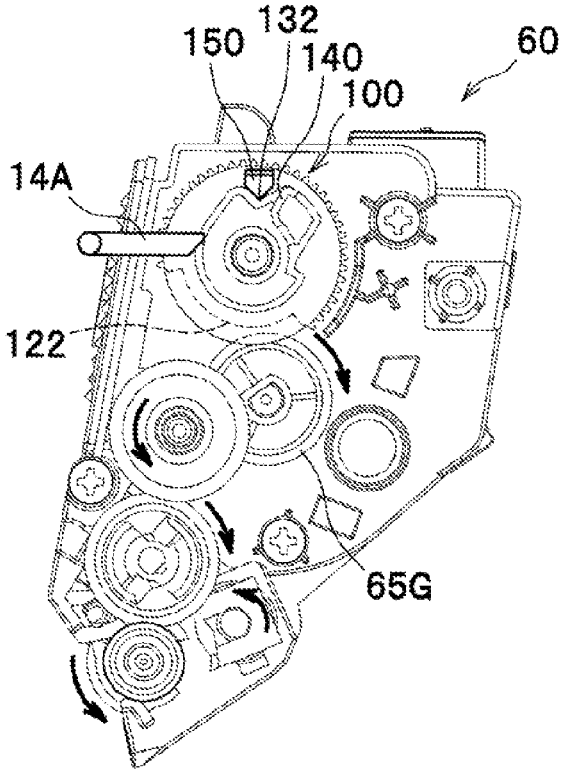

The detection gear 100 provided as above rotates due to execution of the initial turning operation (refer to FIG. 7 (*b*)) when the detection gear 100 is in the first position as illustrated in FIG. 7 (*a*). This causes the detection protrusion 140 to contact the detection arm 14A so as to swing the detection arm 14A, thereby allowing the detection arm 14A to be detected by the optical sensor 14B. In contrast, as illustrated in FIG. 8 (*b*), when the detection gear 100 is in the second position, the detection gear 100 does not rotate despite execution of the initial turning operation, and accordingly, does not cause the detection protrusion 140 to swing the detection arm 14A. Thus, the detection arm 14A is not detectable by the optical sensor 14B.

Next, the detailed structure of the urging portion 150 will be described.

Figure 6:
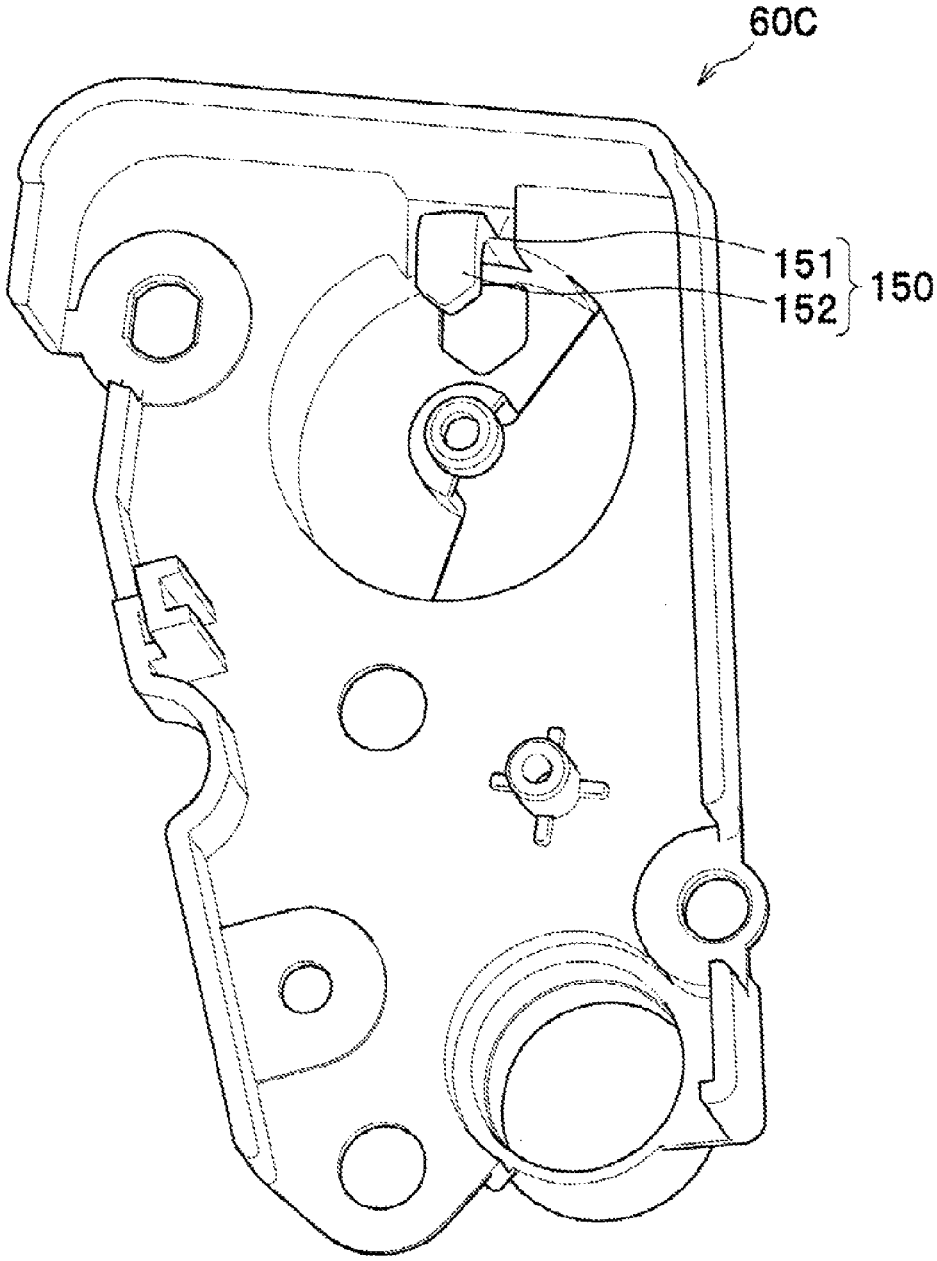
FIG. 6 is a perspective view of the cover body seen from the inside.

As illustrated in FIG. 6, the urging portion 150 has elasticity so as to be able to bend in the upper-lower direction in FIG. 6, and is integrally formed as part of the cover body 60C on the inner surface side of the cover body 60C. Here, the terms "integrally formed" refer to a formation in which, as described above, the urging portion is integrally formed as part of the cover body 60C, and does not refer to a formation in which the urging portion 150 is a separate component formed independently of the cover body 60C and assembled in the cover body 60C.

The urging portion 150 as above can be integrally formed as part of the cover body 60C using, for example, when the cover body 60C is formed of resin, a method in which resin is injected into a mold so as to form a product such as injection molding. Alternatively, the urging portion 150 can be integrally formed as part of the cover body 60C by, for example, when the cover body 60C is formed of a metal plate, cutting and bending part of the metal plate.

As illustrated in FIG. 4 (*a*), the urging portion 150 has a base portion 151 that extends inward (rightward) from the inner surface of the cover body 60C and a touching portion 152 that extends toward the first contact portion 131 (contact surface 130) from the right end of the base portion 151 and contacts (touches) the contact surface 130. In the urging portion 150, the base portion 151 elastically bends in the upper-lower direction so as to allow the touching portion 152 to elastically contact the contact surface 130.

The base portion 151 is provided at a position radially outside the first contact portion 131 (contact surface 130), and the touching portion 152 contacts the contact surface 130 that faces the radially outer direction from an outside position.

As illustrated in FIG. 5 (*a*), when the detection gear 100 is in the first position, the urging portion 150 elastically contacts the first contact portion 131 of the detection gear 100, thereby applying rotational force (refer to the arrow) so as to urge the gear toothed portion 121 of the detection gear 100 toward the agitator gear 65G.

In the present embodiment, the urging portion 150 (touching portion 152) contacts the first contact portion 131 (contact surface 130) that is provided so as to surround the shaft engaging portion 110, or in other words, the first contact portion 131 that is provided at a position further from the rotation center C than the shaft engaging portion 110 is. Thus, compared to such a structure that the urging portion 150 contacts the detection gear 100 at a position close to the rotation center C, the urging portion 150 can effectively apply the rotational force so as to urge the gear toothed portion 121 of the detection gear 100 toward the agitator gear 65G even with small urging force.

In contrast, as illustrated in FIG. 5 (*b*), when the detection gear 100 is in the second position, the urging portion 150 elastically contacts the second contact portion 132 of the detection gear 100, thereby regulating the position of the detection gear 100 in the rotational direction so as to cause the toothless portion 122 of the detection gear 100 and the agitator gear 65G oppose each other.

In the present embodiment, the second contact portion 132 is formed to have a recessed shape in side view, thereby allowing the recess portion to be engaged with the leading end of the urging portion 150. Thus, after the detection gear 100 assumes the second position due to the initial turning operation, the rotation of the detection gear 100 itself can be regulated.

For example, the recessed shape may include a generally V-shaped recess or other type of recess (U-shaped, flat-bottomed recess, and the like) that permits entry of urging portion 150 into it. Likewise, urging portion 150 may be represented as chevron-shaped touching portion 152 or any other shaped touching portion 152 as configured to permit interaction with second contact portion 132.

Operation of Detection Gear

Next, operations of the detection gear 100 will be described in detail.

As illustrated in FIGS. 2 and 7 (*a*), the developer cartridge 60 in the new product state (detection gear 100 is in the first state) is initially mounted in the drawer 51. In this state, since the detection protrusion 140 of the detection gear 100 does not contact the detection arm 14A, the detection arm 14A is maintained at the neutral position.

Next, the developer cartridge 60 mounted in the drawer 51 is mounted in the main body case 10. As a result, the control device 14C causes the initial turning operation to be performed, and the detection gear 100 starts to rotate. Specifically, as illustrated in FIG. 7 (*b*), the driving force of the drive device 13 is transferred to the gear toothed portion 121 of the detection gear 100 using the input gear 63G, the intermediate gear 64G, and the agitator gear 65G, thereby causing the detection gear 100 to rotate counterclockwise as illustrated in the figure.

When the detection gear 100 rotates, the detection protrusion 140 is brought into contact with the detection arm 14A, thereby swinging the detection arm 14A. In this state, the swing of the detection arm 14A is detected by the optical sensor 14B, and accordingly, the optical sensor 14B outputs a specified signal to the control device 14C. As a result, the control device 14C determines that the developer cartridge 60 is a new product.

After that, as illustrated in FIG. 7 (*c*), when the detection protrusion 140 goes beyond the detection arm 14A as the detection gear 100 rotates, the detection arm 14A returns to the neutral position. This causes the optical sensor 14B to stop outputting the specified signal to the control device 14C.

As the detection gear 100 further rotates, as illustrated in FIG. 8 (*a*), the toothless portion 122 of the detection gear 100 opposes the agitator gear 65G, thereby preventing the transfer of the driving force from the agitator gear 65G. In the present embodiment, the gear portion 120 and the contact surface 130 are structured such that the toothless portion 122 and the agitator gear 65G oppose each other before the leading end of the urging portion 150 is completely engaged with the recess-shaped second contact portion 132.

As illustrated in FIG. 8 (*b*), due to the urging force of the urging portion 150 (force of the urging portion 150 trying to be engaged with the recess portion of the second contact portion 132), the detection gear 100 slightly rotates counterclockwise in the figure. This causes the leading end of the urging portion 150 to be completely engaged with the recess portion of the second contact portion 132, thereby regulating rotation of the urging portion 150. By doing this, the detection gear 100 stops in the second position in which the toothless portion 122 and the agitator gear 65G oppose each other, thereby setting the developer cartridge 60 to the used product state.

When the initial turning operation is performed with the developer cartridge 60 in the used product state (when the detection gear 100 is in the second state) mounted in the main body case 10, the detection gear 100 does not rotates, and accordingly, the detection protrusion 140 does not contact the detection arm 14A as illustrated in FIG. 8 (*b*). Thus, since a situation does not occur in which the optical sensor 14B detects the swing of the detection arm 14A and outputs the specified signal to the control device 14C, the control device 14C determines that the developer cartridge 60 is a used product.

Thus, the following operational effects can be achieved with the present embodiment.

The housing 60A of the developer cartridge 60 has the elastic urging portion 150 integrally formed therein that applies, when the detection gear 100 is in the first position, the rotational force so as to urge the gear toothed portion 121 toward the agitator gear 65G, and regulates, when the detection gear 100 is in the second position, the position of the detection gear 100 in the rotational direction so as to cause the toothless portion 122 and the agitator gear 65G oppose each other. Thus, a spring as a separate component required in the related-art structure can be omitted. This can reduce the number of components of the structure involved in the new product detection of the developer cartridge 60. As a result, compared to the related-art cartridges, cost reduction and the ease of assembly can be achieved.

The distance D2 between the rotation center C of the detection gear 100 and the leading end of the urging portion 150 that is in contact with the second contact portion 132 is larger than the distance D1 between the rotational center C and the leading end of the urging portion 150 that is in contact with the first contact portion 131. Thus, the base portion 151 of the urging portion 150 can be more largely bent when the detection gear 100 is in the second position illustrated in FIG. 4 (*b*) than when the detection gear 100 is in the first position illustrated in FIG. 4 (*a*). This causes the urging portion 150 to contact the detection gear 100 with larger urging force when the detection gear 100 is in the second position than when the detection gear 100 is in the first position. Thus, when the detection gear 100 is in the second position, the position of the detection gear 100 in the rotational direction can be more reliably regulated.

In addition, even if the urging portion 150 of the developer cartridge 60 in the new product state (when the detection gear 100 is in the first position) undergoes plastic deformation due to creeping of the material or the like during transportation, storage, and the like, and accordingly, the urging force thereof decreases, the urging force of the urging portion 150 can be recovered since the base portion 151 can be more largely bent when the detection gear 100 is in the second position than in the first position.

As illustrated in FIGS. 5 (*a*) and 5 (*b*), in the present embodiment, the contact surface 130 (surface between the first contact portion 131 and the second contact portion 132) is formed such that the distance between most of the contact surface 130 and the rotation center C is larger than the distance D1. Thus, if the urging portion 150 undergoes plastic deformation and the urging force thereof decreases when the detection gear 100 is in the first position, by performing the initial turning operation and starting the rotation of the detection gear 100, the base portion 151 can be bent more largely than when the detection gear 100 is in the first position. By doing this, the urging force of the urging portion 150 can be recovered.

Since the urging portion 150 is formed in the cover body 60C, the urging portion 150 can be integrally formed using injection molding of resin or by cutting and bending a metal plate more easily compared to a case in which the urging portion 150 is formed in a side surface of the cartridge main body 60B, which also is a side wall of the toner containing portion 64.

Since the urging portion 150 contacts the first contact portion 131 provided at a position further from the rotation center C than the shaft engaging portion 110 is, compared to such a structure that the urging portion 150 contacts the detection gear 100 at a position close to the rotation center C, the urging portion 150 can effectively apply the rotational force so as to urge the gear toothed portion 121 of the detection gear 100 toward the agitator gear 65G even with small urging force.

According to the present invention, in order for the urging portion 150 to apply appropriate urging force to the detection gear 100, the positional relationship between the urging portion 150 and the detection gear 100 (rotation center C) is important. In the above-described embodiment, the detection gear 100 is rotatably supported by the cover body 60C (also by the cartridge main body 60B). In other words, the urging portion 150 and the rotation shaft 67C are provided in the cover body 60C, thereby allowing the positional accuracies of the urging portion 150 and the rotation shaft 67C to be improved. By doing this, positional accuracies of the urging portion 150 and the detection gear 100 (rotation center C) that is rotatably supported by the rotation shaft 67C can be improved.

Figure 9B:
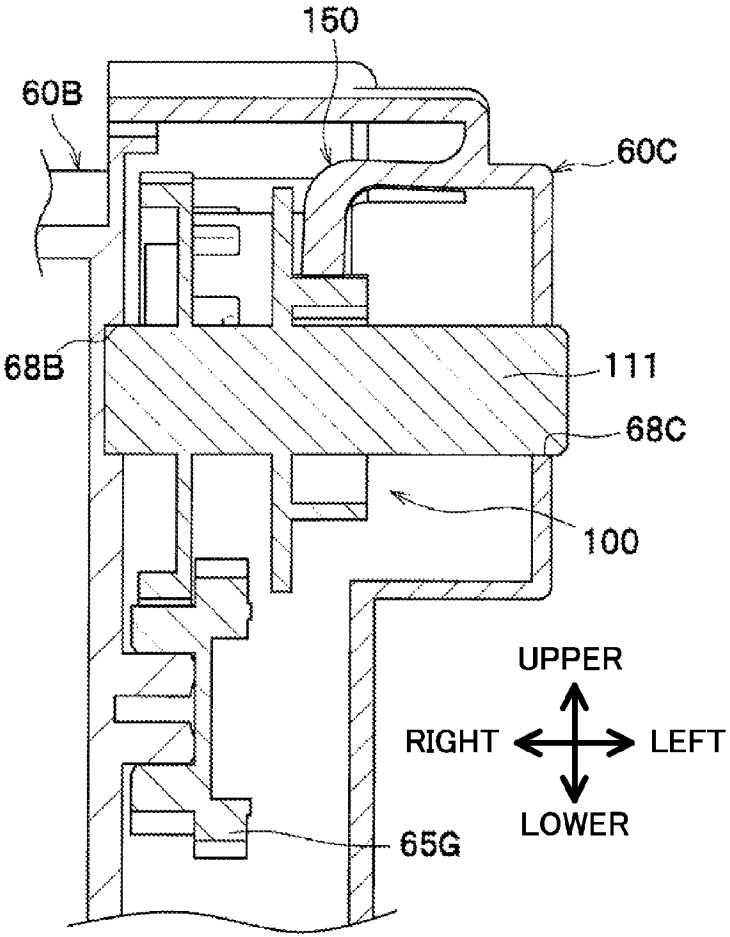
FIG. 9 includes views (a) and (b) that illustrate modifications of a first embodiment, corresponding to the sectional views taken along line X-X in FIG. 3.
Figure 9A:
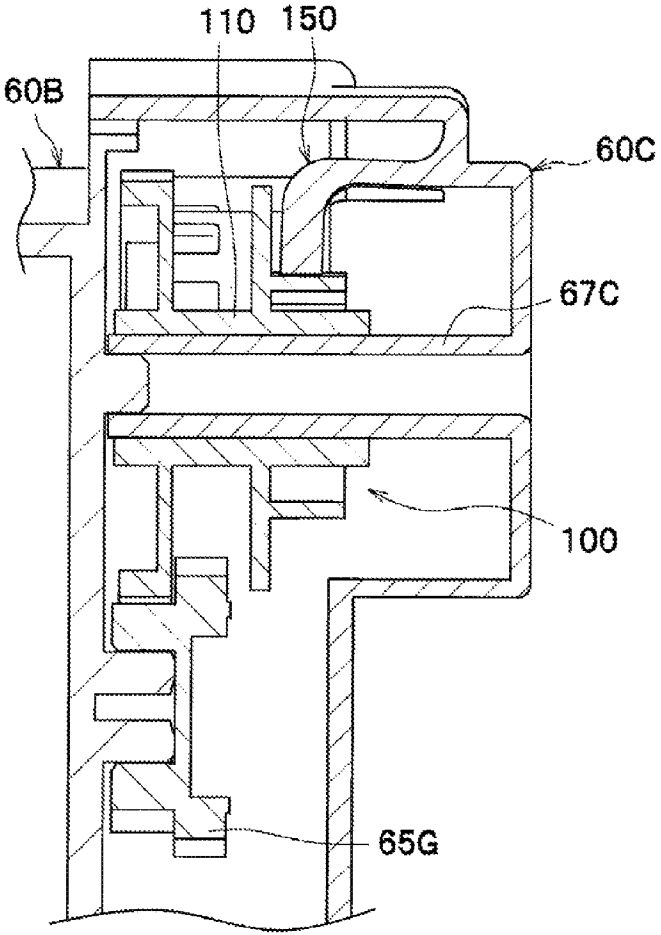

In the present embodiment, a structure in which the rotation shafts 67C and 67B respectively provided in the cover body 60C and the cartridge main body 60B are engaged with the shaft engaging portion 110 of the detection gear 100 is illustrated as an example of a structure in which the detection gear 100 is rotatably supported by the cover body 60C and the cartridge main body 60B. However, the structure is not limited to this. For example, as illustrated in FIG. 9 (*a*), the rotation shaft 67C may be provided only in the cover body 60C. In this case, by engaging the rotation shaft 67C with the shaft engaging portion 110 of the detection gear 100, the detection gear 100 is rotatably supported solely by the cover body 60C.

In the present embodiment, a structure in which the detection gear 100 is rotatably supported by the rotation shafts 67C and 67B provided in the cover body 60C and the cartridge main body 60B (housing 60A) is illustrated as an example of a structure in which the detection gear 100 is rotatably supported. However, the structure is not limited to this. For example, as illustrated in FIG. 9 (*b*), the detection gear 100 may have a rotation shaft 111. In this case, the rotation shaft 111 is rotatably supported by a bearing recess portion 68B formed in the cartridge main body 60B and a bearing hole 68C formed in the cover body 60C.

In both of the embodiments in FIGS. 9 (*a*) and 9 (*b*), since the urging portion 150 and the rotation shaft 67C or the bearing hole 68C, by which the detection gear 100 is rotatably supported, are provided in the cover body 60C, positional accuracies of the urging portion 150 and the detection gear 100 (rotation center C) can be improved.

Second Embodiment

Next, a second embodiment according to the present invention will be described. In the present embodiment, components similar to those in the first embodiment are denoted by the same signs and descriptions thereof are omitted.

In the above-described first embodiment, the detection gear 100 is rotatably supported by the cover body 60C in which the urging portion 150 is provided, thereby improving the positional accuracies of the urging portion 150 and the detection gear 100 (rotation center C). In the present embodiment, although the detection gear 100 is not directly rotatably supported by the cover body 60C, the positional accuracies of the urging portion 150 and the detection gear 100 can be improved.

Figure 10B:
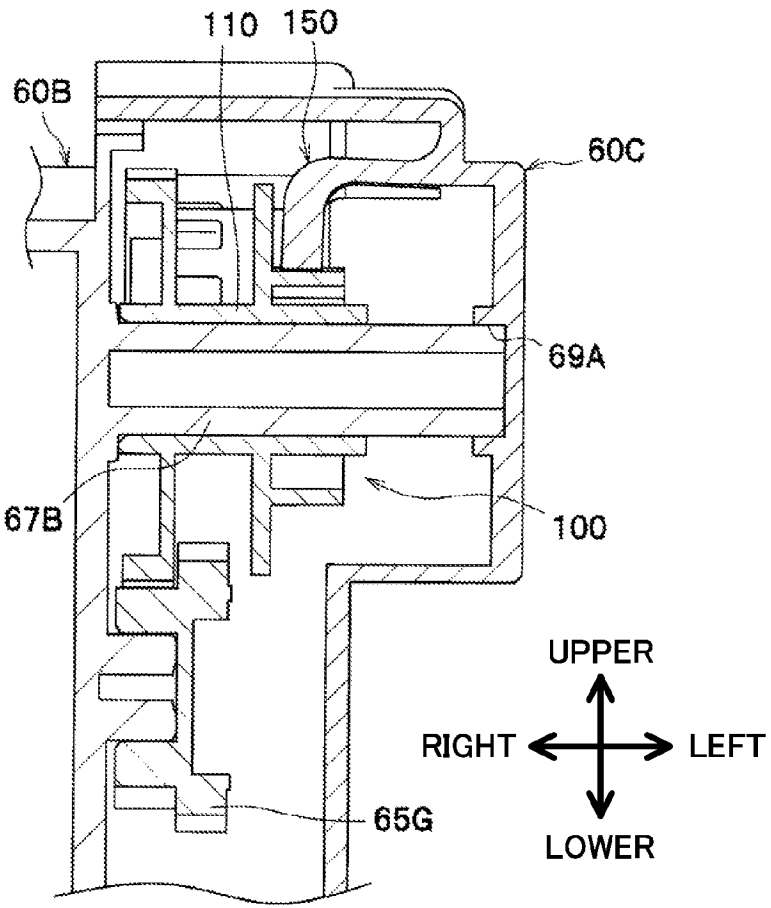
FIG. 10 includes views (a) and (b) that respectively illustrate the developer cartridge according to a second embodiment and a modification of the second embodiment, corresponding to the sectional views taken along line X-X in FIG. 3.
Figure 10A:
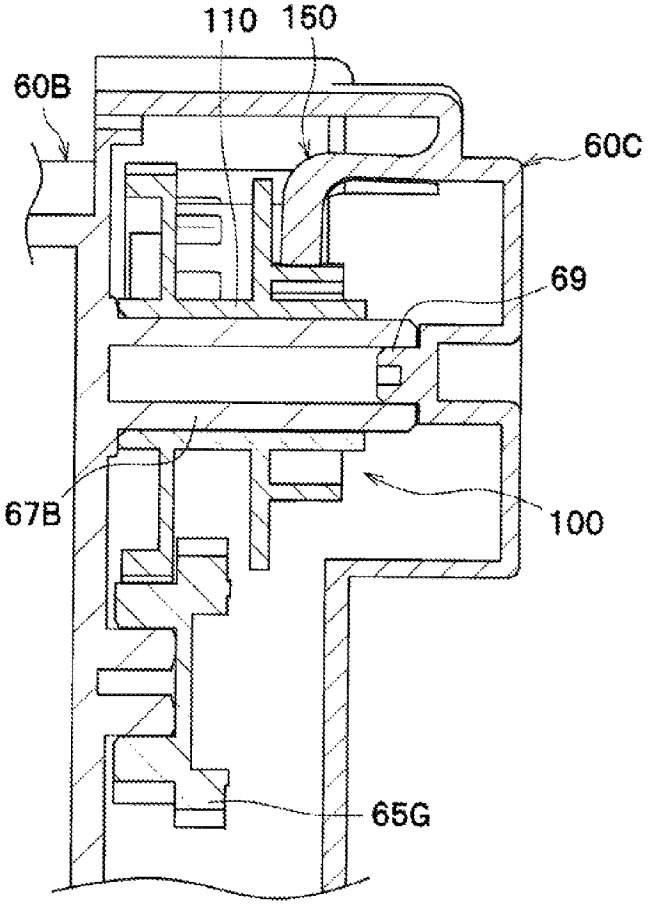

Specifically, as illustrated in FIG. 10 (*a*), only the cartridge main body 60B has the cylindrical rotation shaft 67B in the present embodiment. This rotation shaft 67B is engaged with the shaft engaging portion 110 of the detection gear 100 so as for the detection gear 100 to be rotatably supported by the cartridge main body 60B.

The cover body 60C of the present embodiment has a boss 69 that protrudes inward (rightward) from the inner surface side as an example of a positioning portion. The leading end (right end) of the boss 69 is engageable with the cylindrical rotation shaft 67B. The boss 69 is, when the cover body 60C is mounted to the cartridge main body 60B, engaged with the rotation shaft 67B so as to determine the mounting position of the cover body 60C relative to the cartridge main body 60B.

According to the present embodiment as described above, the urging portion 150 and the boss 69 are provided in the cover body 60C, thereby allowing positional accuracies of the urging portion 150 and the boss 69 to be improved. Since the boss 69 is engaged with the rotation shaft 67B of the cartridge main body 60B so as to determine the position of the cover body 60C (urging portion 150) relative to the cartridge main body 60B (detection gear 100), improvement in positional accuracies of the urging portion 150 and the boss 69 can, as a result, improve positional accuracies of the urging portion 150 and the detection gear 100 (rotation center C).

In a structure according to the present embodiment, compared to the structure in which the detection gear 100 is directly rotatably supported only by the cover body 60C, the detection gear 100 can be initially rotatably supported by the cartridge main body 60B so as to be stabilized, and then the cover body 60C can be mounted to the cartridge main body 60B. This can facilitate assembly of the developer cartridge 60.

In the present embodiment, the boss 69 that protrudes inward from the inner surface side of the cover body 60C is illustrated as an example of a positioning portion. However, the positioning portion is not limited to this. For example, as illustrated in FIG. 10 (*b*), a recess portion 69A, which is engaged with the leading end (left end) of the rotation shaft 67B of the cartridge main body 60B, or a through hole (not shown) may be used as the positioning portion.

The positioning portion may not be engaged with the rotation shaft 67B of the cartridge main body 60B as long as the positioning portion can improve positional accuracies of the urging portion 150 and the detection gear 100 (that is, the positioning portion may be provided at another position in the cover body 60C). However, by being engaged with the rotation shaft 67B, the urging portion 150 is positioned relative to the positioning portion during manufacturing of the cover body 60C. This allows the urging portion 150 to be more directly positioned relative to the detection gear 100 (rotation center C), and accordingly, the positional accuracies to be improved.

Although the embodiments according to the present invention have been described, the present invention is not limited to the above-described embodiments. The specific structures may be changed where appropriate without departing the gist of the present invention.

Figure 11:
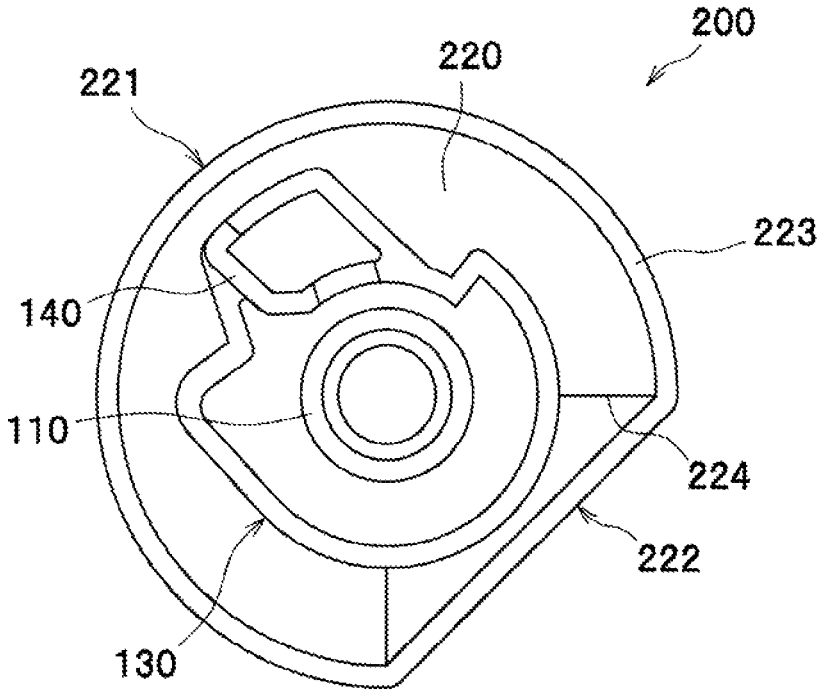
FIG. 11 is a side view of a rubber roller as an alternative example of a first rotating body.

In the above-described embodiments, the detection gear 100 having the gear portion 120 is illustrated as an example of the first rotating body. However, the present invention is not limited to this. For example, as illustrated in FIG. 11, a rubber roller 200 may be used as the first rotating body. To add supplementary description, the rubber roller 200 has a belt support portion 220 formed by cutting part of a disc in a substantially sector shape instead of the gear portion 120 of the above-described embodiment. An endless rubber belt 223 is stretched around the outer periphery of the belt support portion 220.

In the rubber roller 200, part of the rubber belt 223 that contacts the outer periphery of the belt support portion 220 serves as a transfer portion 221. The transfer portion 221, when it opposes the second rotating body such as an agitator gear 65G of the above-described embodiment, rotates the rubber roller 200 by contacting the second rotating body so as to cause the driving force to be transferred from the second rotating body. Part of the rubber belt 223, the inner periphery of which faces a cutout portion 224 of the belt support portion 220, is brought out of contact with the second rotating body when this part of the rubber belt 223 opposes the second rotating body, thereby serves as a non-transfer portion 222 that disables the transfer of the driving force from the second rotating body.

In the above-described embodiments, the agitator gear 65G is illustrated as an example of the second rotating body. However, the present invention is not limited to this. For example, a driving force transfer gear (not shown) provided between the agitator gear 65G and the detection gear 100 of the above-described embodiment, or the like may be used. Alternatively, a friction wheel (roller), an endless belt, or an endless chain may be used as the second rotating body.

In the above-described embodiments, the distance D2 between the rotation center C of the detection gear 100 (first rotating body) and the leading end of the urging portion 150 that is in contact with the second contact portion 132 is larger than the distance D1 between the rotational center C and the leading end of the urging portion 150 that is in contact with the first contact portion 131. That is, in the above-described embodiments, the distances D1 and D2 are compared, which are the distances between the rotation center C and the leading end of the urging portion 150 in a case in which the leading end of the urging portion 150 contacts the contact portion 131 and in a case in which the leading end of the urging portion 150 contacts the contact portion 132. The present invention is not limited to this. For example, the distance between the rotation center C and the base portion 151 of the urging portion 150 may be compared between a case in which the base portion 151 of the urging portion 150 contacts the contact portion 131 and a case in which the base portion 151 of the urging portion 150 contacts the contact portion 132. To add supplementary description, the comparison of distances between the rotation center and the urging portion according to the present invention is sufficient when the distance between the rotation center and an identical position of the urging portion is compared between the case of the first position and the case of the second position.

In the above-described embodiments, the detection gear 100 (first rotating body) includes the continuous contact surface 130, part of which from the first contact portion 131 to the second contact portion 132 extends substantially along a peripheral direction of the shaft engaging portion 110. However, the present invention is not limited to this. For example, the first rotating body may have a discontinuous contact surface in the peripheral direction from the first contact portion to the second contact portion. The first rotating body may be contacted by the urging portion only at (near) the first contact portion and the second contact portion, that is, the first rotating body may be mainly contacted by the urging portion only when the first rotating body is in the first position or in the second position.

In the above-described embodiments, the urging portion 150, which has the base portion 151 extending from the inner surface of the cover body 60C and the touching portion 152 extending from the base portion 151 toward the first contact portion 131, is illustrated as an example. However, the present invention is not limited to this. For example, the urging portion may not have the touching portion 152 of the above-described embodiments.

In the above-described embodiments, the urging portion 150 is formed in the cover body 60C. However, the present invention is not limited to this. For example, the urging portion 150 may be formed in the cartridge main body 60B. In the above-described embodiments, the housing 60A, which has the cartridge main body 60B and the cover body 60C, is illustrated as an example. However, the structure of the housing is not limited to the structure in the above-described embodiments.

In the above-described embodiments, the developer cartridge 60 (cartridge) having been mounted in the drawer 51 is removably mounted in the main body case 10 (main body of the image forming apparatus). However, the present invention is not limited to this. For example, the cartridge may be removably mounted directly in the main body of the image forming apparatus.

In the above-described embodiments, the developer cartridge 60 having the developer roller 61 and the toner containing portion 64 is illustrated as an example of the cartridge. However, the present invention is not limited to this. For example, the cartridge may be a process cartridge that further includes the photoreceptor drum and the like in addition to the developer roller and the toner containing portion, or may be a toner cartridge that includes the toner containing portion and the agitator (and does not include the developer roller).

The structure (structure of the new product detection in the color printer 1) that detects the detection protrusion 140 of the detection gear 100 (detection target portion of the first rotating body) illustrated in the above-described embodiments is only an example. The present invention is not limited to the structures of the above-described embodiments. That is, the structure of the new product detection of the image forming apparatus may use, as described above, a widely known structure. The structure of the detection target portion of the first rotating body may be changed where appropriate in accordance with the structure of the new product detection of the image forming device.

In the above-described embodiments, the color printer 1 is illustrated as an example of the image forming apparatus in which the cartridge according to the present invention is mounted. However, the image forming apparatus is not limited to this and may be a printer that forms monochrome images. The image forming apparatus is not limited to the printer. The image forming apparatus may be, for example, a copying machine or a multi-function machine including a document reader such as a flat-bed scanner.

What is claimed is:

1. A cartridge configured to be removably mounted in a main body of an image forming apparatus, the cartridge comprising:

a housing including an elastic urging portion integrally formed therein;

a first rotating body including a detection target portion configured to be detectable by detecting means of the main body of the image forming apparatus, the first rotating body being provided at the housing such that the first rotating body is rotatable relative to the housing, the first rotating body including a transfer portion configured to rotate the first rotating body when a driving force is applied and a non-transfer portion configured to disable rotation of the first rotating body; and a second rotating body provided at the housing such that the second rotating body is rotatable relative to the housing, the second rotating body being able to transfer driving force input from the main body of the image forming apparatus to the first rotating body, wherein, when the transfer portion opposes the second rotating body, the first rotating body is configured to rotate upon receiving the driving force from the second rotating body, and, when the non-transfer portion opposes the second rotating body, the driving force from the second rotating body is not transferred to the first rotating body, wherein the first rotating body is rotatable between a first position and a second position, the first position being a position in which the detection target portion is detectable by the detecting means and the transfer portion opposes the second rotating body, the second position being a position in which the detection target portion is undetectable by the detecting means and the non-transfer portion opposes the second rotating body, wherein when the first rotating body is in the first position, the elastic urging portion, is configured to contact the first rotating body and impart rotational force so as to urge at least a portion of the transfer portion to be opposed to the second rotating body, and when the first rotating body is in the second position, the elastic urging portion is configured to contact the first rotating body and regulate a rotation of the first rotating body in a rotational direction so as to cause the non-transfer portion and the second rotating body to oppose each other.

2. The cartridge according to claim 1, wherein the first rotating body has a first contact portion and a second contact portion, the first contact portion being contacted by the elastic urging portion when the first rotating body is in the first position, the second contact portion being contacted by the elastic urging portion when the first rotating body is in the second position, and wherein a distance between a rotation center of the first rotating body and the elastic urging portion that is in contact with the second contact portion is larger than a distance between the rotation center of the first rotating body and the elastic urging portion that is in contact with the first contact portion.

3. The cartridge according to claim 1, wherein the housing has a cartridge main body and a cover body, the cartridge main body containing developer, the cover body being mounted so as to cover the first rotating body and the second rotating body, and wherein the elastic urging portion is formed in the cover body.

4. The cartridge according to claim 3, wherein the cartridge main body has a rotation shaft that rotatably supports the first rotating body, and wherein the cover body has a positioning portion that is configured to engage with the rotation shaft so as to position the cover body relative to the cartridge main body.

5. The cartridge according to claim 3, wherein the cover body rotatably supports the first rotating body.

6. The cartridge according to claim 1, wherein the first rotating body has the first contact portion contacted by the elastic urging portion when the first rotating body is in the first position, wherein the first contact portion is provided at a position radially outside a surface that supports rotation of the first rotating body, the first contact portion facing toward the radially outer direction of the first rotating body, wherein the elastic urging portion has a base portion provided at a position radially outside the first contact portion and a touching portion that extends from the base portion toward the first contact portion, the touching portion contacting the first contact portion.

7. The cartridge according to claim 1, wherein the housing is configured to contain a developer.

8. The cartridge according to claim 1, wherein the detection means includes an optical sensor.

9. An image forming apparatus comprising:

a main body; and a cartridge, the cartridge including:

a housing including an elastic urging portion integrally formed therein;

a first rotating body including a detection target portion configured to be detectable by detecting means of the main body of the image forming apparatus, the first rotating body being provided at the housing such that the first rotating body is rotatable relative to the housing, the first rotating body including a transfer portion configured to rotate the first rotating body when a driving force is applied and a non-transfer portion configured to disable rotation of the first rotating body; and a second rotating body provided at the housing such that the second rotating body is rotatable relative to the housing, the second rotating body being able to transfer driving force input from the main body of the image forming apparatus to the first rotating body, wherein, when the transfer portion opposes the second rotating body, the first rotating body is configured to rotate upon receiving the driving force from the second rotating body, and, when the non-transfer portion opposes the second rotating body, the driving force from the second rotating body is not transferred to the first rotating body, wherein the first rotating body is rotatable between a first position and a second position, the first position being a position in which the detection target portion is detectable by the detecting means and the transfer portion opposes the second rotating body, the second position being a position in which the detection target portion is undetectable by the detecting means and the non-transfer portion opposes the second rotating body, wherein when the first rotating body is in the first position, the elastic urging portion, is configured to contact the first rotating body and impart rotational force so as to urge at least a portion of the transfer portion to be opposed to the second rotating body, and when the first rotating body is in the second position, the urging portion is configured to contact the first rotating body and regulate the rotation of the first rotating body in a rotational direction so as to cause the non-transfer portion and the second rotating body to oppose each other.

10. The image forming apparatus according to claim 9, wherein the first rotating body has a first contact portion and a second contact portion, the first contact portion being contacted by the elastic urging portion when the first rotating body is in the first position, the second contact portion being contacted by the elastic urging portion when the first rotating body is in the second position, and wherein a distance between a rotation center of the first rotating body and the elastic urging portion that is in contact with the second contact portion is larger than a distance between the rotation center of the first rotating body and the elastic urging portion that is in contact with the first contact portion.

11. The image forming apparatus according to claim 9, wherein the housing has a cartridge main body and a cover body, the cartridge main body containing developer, the cover body being mounted so as to cover the first rotating body and the second rotating body, and wherein the elastic urging portion is formed in the cover body.

12. The image forming apparatus according to claim 11, wherein the cartridge main body has a rotation shaft that rotatably supports the first rotating body, and wherein the cover body has a positioning portion that is configured to engage with the rotation shaft so as to position the cover body relative to the cartridge main body.

13. The image forming apparatus according to claim 11, wherein the cover body rotatably supports the first rotating body.

14. The image forming apparatus according to claim 9, wherein the first rotating body has the first contact portion contacted by the elastic urging portion when the first rotating body is in the first position, wherein the first contact portion is provided at a position radially outside a surface that supports rotation of the first rotating body, the first contact portion facing toward the radially outer direction of the first rotating body, wherein the elastic urging portion has a base portion provided at a position radially outside the first contact portion and a touching portion that extends from the base portion toward the first contact portion, the touching portion contacting the first contact portion.

15. A cartridge comprising:

a housing including an elastic urging portion integrally formed therein;

a first rotating body including a detection target portion, the first rotating body being provided at the housing such that the first rotating body is rotatable relative to the housing, the first rotating body including a transfer portion configured to rotate the first rotating body when a driving force is applied and a non-transfer portion configured to disable rotation of the rotating body; and a second rotating body provided at the housing such that the second rotating body is rotatable relative to the housing, the second rotating body being able to transfer a driving force to the first rotating body, wherein, when the transfer portion opposes the second rotating body, the first rotating body is configured to rotate upon receiving the driving force from the second rotating body, and, when the non-transfer portion opposes the second rotating body, the driving force from the second rotating body is not transferred to the first rotating body, wherein the first rotating body is rotatable between a first position and a second position, the first position being a position in which the detection target portion is at a first rotational orientation and the transfer portion opposes the second rotating body, the second position being a position in which the detection target portion is at a second rotational orientation and the non-transfer portion opposes the second rotating body, wherein when the first rotating body is in the first position, the elastic urging portion, is configured to contact the first rotating body and impart rotational force so as to urge at least a portion of the transfer portion to be opposed to the second rotating body, and when the first rotating body is in the second position, the elastic urging portion is configured to contact the first rotating body and regulate the rotation of the first rotating body in a rotational direction so as to cause the non-transfer portion and the second rotating body to oppose each other.

16. The cartridge according to claim 15, wherein the first rotating body has a first contact portion and a second contact portion, the first contact portion being contacted by the elastic urging portion when the first rotating body is in the first position, the second contact portion being contacted by the elastic urging portion when the first rotating body is in the second position, and wherein a distance between a rotation center of the first rotating body and the elastic urging portion that is in contact with the second contact portion is larger than a distance between the rotation center of the first rotating body and the urging portion that is in contact with the first contact portion.

17. The cartridge according to claim 15, wherein the housing has a cartridge main body and a cover body, the cartridge main body containing developer, the cover body being mounted so as to cover the first rotating body and the second rotating body, and wherein the elastic urging portion is formed in the cover body.

18. The cartridge according to claim 17, wherein the cartridge main body has a rotation shaft that rotatably supports the first rotating body, and wherein the cover body has a positioning portion that is configured to engage with the rotation shaft so as to position the cover body relative to the cartridge main body.

19. The cartridge according to claim 17, wherein the cover body rotatably supports the first rotating body.

20. The cartridge according to claim 15, wherein the first rotating body has the first contact portion contacted by the elastic urging portion when the first rotating body is in the first position, wherein the first contact portion is provided at a position radially outside a surface that supports rotation of the first rotating body, the first contact portion facing toward the radially outer direction of the first rotating body, wherein the elastic urging portion has a base portion provided at a position radially outside the first contact portion and a touching portion that extends from the base portion toward the first contact portion, the touching portion contacting the first contact portion.

* * * * *